United States Patent [19]

Billing, Jr. et al.

[11] 4,108,074

[45] Aug. 22, 1978

[54] FRANGIBLE TARGET PRACTICE PROJECTILE

[75] Inventors: Rudolph W. Billing, Jr., Littleton; Charles M. Conlon, Jr., Andover, both of Mass.

[73] Assignee: Avco Corporation, Wilmington, Mass.

[21] Appl. No.: 791,216

[22] Filed: Apr. 27, 1977

[51] Int. Cl.[2] ..... F42B 9/20

[52] U.S. Cl. ..... 102/92.7; 264/279; 264/328

[58] Field of Search ..... 102/43 P, 92.3, 92.4, 102/92.7; 264/279, 328

[56] References Cited

U.S. PATENT DOCUMENTS

| | | | |
|---|---|---|---|
| 3,144,827 | 8/1964 | Boutwell | 102/43 P |
| 3,159,701 | 12/1964 | Herter | 264/279 |
| 3,786,760 | 1/1974 | Feldmann | 102/93 |
| 3,902,683 | 9/1975 | Bilsbury | 102/92.7 |

FOREIGN PATENT DOCUMENTS

| | | | |
|---|---|---|---|
| 1,007,227 | 10/1965 | United Kingdom | 102/92.7 |

*Primary Examiner*—Verlin R. Pendegrass
*Attorney, Agent, or Firm*—Abraham Ogman; Ralph D. Gelling

[57] ABSTRACT

In order to provide a frangible projectile for use in aircraft target practice, a combination steel and plastic projectile is constructed. This unit consists of a steel cup into which a glass reinforced plastic ogive is injection molded. During the same injection molding process, a plastic rotating band is installed around the periphery of the projectile.

9 Claims, 2 Drawing Figures

FRANGIBLE TARGET PRACTICE PROJECTILE

BACKGROUND OF THE INVENTION

Aircraft gunnery practice requires an inexpensive form of ammunition which accurately simulates the ballistic characteristics of the normal load used in hostile action. The need for target practice ammunition usually far exceeds the amount maintained for wartime reserve. Therefore, any economies that can be accomplished in the cost of a target practice round would result in substantial savings.

The conventional target practice projectile which is shot from a moving airplane has shown a tendency to ricochet or broach upon the ground during strafing runs, thereby endangering other aircraft and personnel in the vicinity. This also severely limits the locations at which this activity can be performed.

It is, therefore, the object of this invention to provide an economical practice round which will break up on ground impact, minimize ricochets and limit high velocity fragments after impact.

A solid plastic projectile which could be injection molded in a one-shot step was investigated. However, it proved extremely difficult to obtain the desired ballistic characteristics without the use of high density plastics with sophisticated fillers, thereby defeating the advantages of using plastic. Similar problems arose with respect to flexural strength requirements. It is therefore an object of this invention to provide a combination steel and plastic projectile which can be assembled with conventional injection molding techniques and utilize ordinary filled plastic material.

SUMMARY OF THE INVENTION

The projectile of this invention consists of a steel cup having a slightly conical shape at its forward opening. A glass-reinforced ogive is injection molded into the steel cup and is trapped in place by the conical nosing of the cup opening. A plastic rotating band is injection molded on the outer periphery of the cup. To aid in the molding process, a hole is constructed in the base of the cup and this hole is securely plugged after the ogive is in place.

DESCRIPTION OF THE DRAWING

This invention is described in more detail below with reference to the attached drawing and in said drawing.

DESCRIPTION OF THE PREFERRED EMBODIMENT

Figure 1:
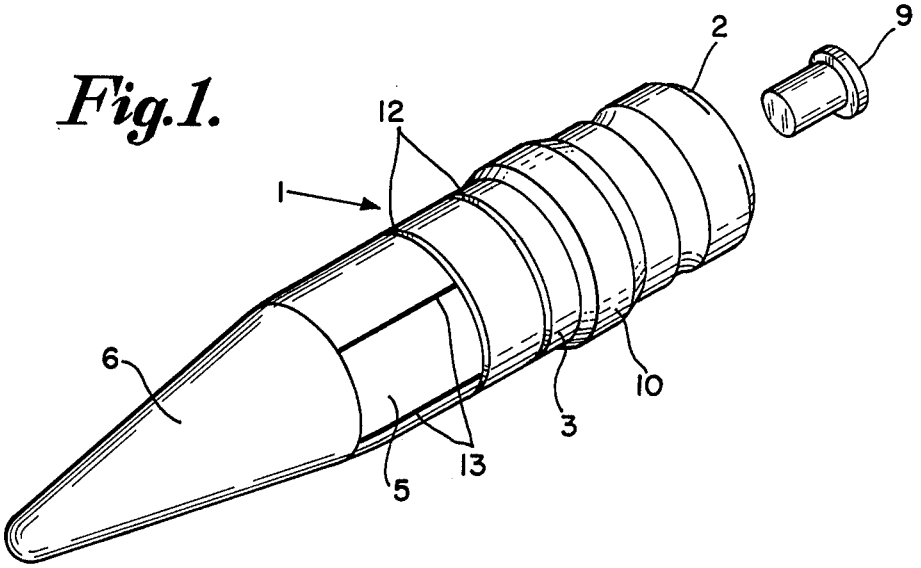
FIG. 1 is a perspective view of the assembled projectile of this invention.

The basic supporting structure of the projectile of this invention is provided by a steel cup 1 consisting of a base 2, a sleeve 3, and an interior cavity 4. The sleeve 3 is nosed inward at the forward end 5 to form a slightly reduced opening to the cavity 4. The cup can be manufactured by standard impact extrusion techniques and is particularly suited to high production.

The ogive or nose portion 6 of the projectile is formed of a glass reinforced plastic material such as Nylon 6/12 filled with between 30 and 50 percent glass. The ogive 6 is injection molded into steel cup 1 and is trapped in place by the conical forward end 5 of sleeve 3. Under certain circumstances, an additional mechanical lock between the ogive 6 and the interior of the sleeve 3 can be provided by constructing groove 7 in the walls of cavity 4. If desired, a chemical bond can be constructed by the use of adhesives in the molding cycle.

In order to facilitate the injection molding process, an exit 8 is formed in the base 2 of the steel cup 1 to allow hot gases to be expelled and to insure that the steel cup 1 is completely filled. Exit 8 is closed in the final assembly by a steel plug 9. It has been found that by constructing plug 9 so that it is released on impact, the energy-absorbing characteristics of the projectile are improved, thereby reducing the possibility of ricochet.

Preferably in the same process, a rotating band 10 is molded to the periphery of sleeve 3 into a groove 11 formed therein. It is desirable that ring 10 be constructed of the same material as ogive 6 to enable the construction of the two elements in a single shot injection.

Figure 2:
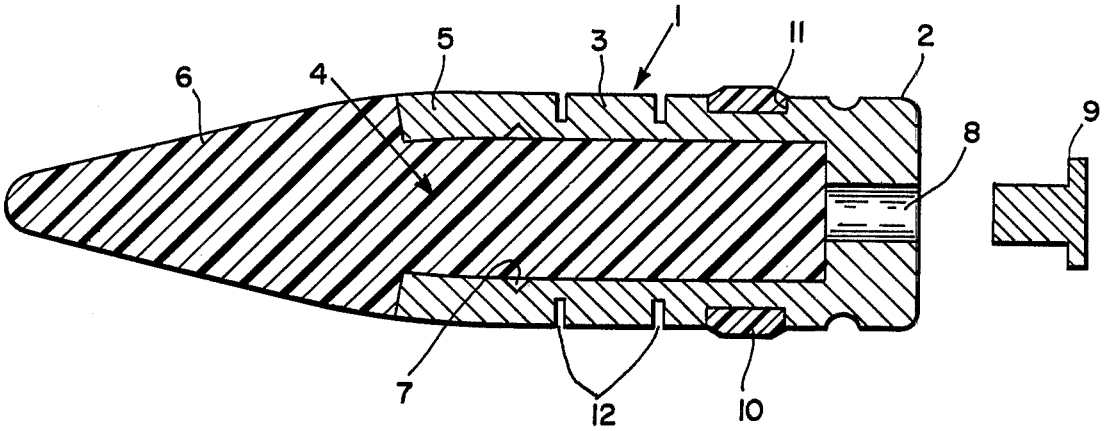
FIG. 2 is a cross sectional view of the projectile through its longitudinal axis.

As shown in FIG. 2, in order to further enhance the frangible character of the projectile of this invention and reduce any possible lethal effect of the cup 1, slits 12 can be constructed in the outer surface of sleeve 3. As an alternative, longitudinal slots 13 may be formed in the cup sleeve 3 to further insure breakup. The slots would be through the sleeve 3 and would fill with plastic during the injection molding process. A finishing step may be necessary to obtain a smooth outer surface.

In this manner, a combination steel and plastic projectile is constructed which significantly reduces the risk of damage or personal injury from the ricochet of airborne debris resulting from the use of live ammunition for target practice while maintaining the desired ballistic characteristics of a standard round of ammunition. The projectile of this invention is very economical to manufacture and will result in significant savings.

The simplicity of design is readily adaptable to a variety of ammunition sizes; for example, 20 mm, 25 mm, 30 mm, and even up to 55 mm rounds. This flexibility will require modifications in the cup design in order to achieve a ballistic match with standard ammunition. For example, with longer projectiles, the length of the cup must be expanded to absorb increased bending forces during flight. The increased size may require slots in the cup sleeve to maintain frangibility. Also, in order to limit the volume of plastic material forming the ogive of large projectiles, an extension to the plug may be required to form a void through the center of the projectile.

According to the above description, the following invention is claimed as novel and is desired to be secured by Letters Patent in the United States.

1. A combination steel and plastic projectile for a round of ammunition used in target practice comprising:

a cylindrical steel cup having an open interior cavity therein defined by side and botton walls, said bottom wall having an aperture constructed therein to allow the release of hot gases therefrom;

a plastic nose element injection molded into the cup and extending outward therefrom to form an ogive for the projectile;

means to lock the nose element in the interior cavity;

a rotating band injection molded to the periphery of the cup; and means to plug the aperture after assembly of the projectile.

2. A combination steel and plastic projectile for a round of ammunition used in target practice as described in claim 1 wherein the means to plug the aperture is constructed to release on impact to absorb energy.

3. A combination steel and plastic projectile for a round of ammunition used in target practice as described in claim 1 wherein a circumferential slit is constructed in the cup to facilitate the cup's breakup on impact.

4. A combination steel and plastic projectile for a round of ammunition used in target practice as described in claim 1 wherein longitudinal slots are constructed through the cup to facilitate the cup's breakup on impact, said slots being filled with plastic during the injection molding of the nose element.

5. A combination steel and plastic projectile for a round of ammunition used in target practice as described in claim 1 wherein the nose element is constructed of glass-filled nylon.

6. A projectile for a round of ammunition used in target practice comprising:

a cylindrical steel cup having an open interior cavity defined by side and bottom walls, said bottom wall having an air-release aperture constructed therein, the cup being conically reduced at the opening of said cavity;

a nose element constructed of glass-filled nylon injection molded into the cup and extending outward therefrom to form an ogive for the projectile, said nose element being trapped by the reduced portion of the cup;

a rotating band injection molded to the periphery of the cup; and a plug inserted into the air-release aperture after the projectile is assembled to seal the aperture, said plug constructed to release upon impact.

7. A method of manufacturing a projectile for a round of ammunition used in target practice comprising:

constructing a cylindrical steel cup having an open interior cavity defined by bottom and side walls, said bottom wall having an air-release opening therein;

injection molding a shot of plastic material into the cup to form an ogive for the projectile;

injection molding a rotating band onto the periphery of the cup; and sealing the air-release opening.

8. A method of manufacturing a projectile for a round of ammunition used in target practice as described in claim 7 wherein the ogive and the rotating band are injection molded to the cup in a single injection molding step.

9. A method of manufacturing a projectile for a round of ammunition used in target practice as described in claim 8 further comprising the step of mechanically trapping the ogive in the cup by constructing a locking surface on the side wall of the cavity.

* * * * *